US012557949B2

(12) United States Patent
Bright

(10) Patent No.: US 12,557,949 B2
(45) Date of Patent: Feb. 24, 2026

(54) SYSTEM AND METHOD FOR MOUNTING A PORTABLE TOILET SEAT TO AN EXTERNAL STRUCTURE

(71) Applicants: Timothy Asaph Bright, Clarksburg, MD (US); David Ben Martinez, Gaithursburg, MD (US)

(72) Inventor: Timothy Asaph Bright, Clarksburg, MD (US)

( * ) Notice: Subject to any disclaimer, the term of this patent is extended or adjusted under 35 U.S.C. 154(b) by 67 days.

(21) Appl. No.: 18/586,460

(22) Filed: Feb. 24, 2024

(65) Prior Publication Data

US 2025/0268436 A1 Aug. 28, 2025

(51) Int. Cl.
*A47K 13/00* (2006.01)
*A47K 13/26* (2006.01)

(52) U.S. Cl.
CPC ..... *A47K 13/26* (2013.01); *A47K 13/005* (2013.01)

(58) Field of Classification Search
CPC ..... A47K 13/005; A47K 13/26; A47K 11/00; A47K 11/02; A47K 11/12; A47K 11/04; A47C 9/10; A01M 31/02; A01M 31/025
See application file for complete search history.

(56) References Cited

U.S. PATENT DOCUMENTS

| | | | | | |
|---|---|---|---|---|---|
| 362,969 | A * | 5/1887 | Jacobus | A47K 3/122 | 4/237 |
| 2,722,968 | A * | 11/1955 | Smith | A01M 31/02 | 182/187 |
| 5,083,324 | A * | 1/1992 | Strong | A47K 11/04 | 182/187 |
| 5,307,526 | A * | 5/1994 | Appleby | A47K 11/00 | 4/483 |
| 6,081,942 | A * | 7/2000 | Bellamy | A47K 11/02 | 297/440.1 |
| 7,927,321 | B2 * | 4/2011 | Marland | A47K 11/02 | 182/9 |
| 8,925,681 | B1 * | 1/2015 | Mattingly | A47C 4/00 | 182/7 |
| 9,161,665 | B2 * | 10/2015 | Cahoon | A47K 11/02 | |
| 10,201,257 | B2 * | 2/2019 | Sandberg | A62B 35/0012 | |
| 11,766,155 | B2 * | 9/2023 | Terry | A47K 13/26 | 4/237 |
| 2012/0023652 | A1 * | 2/2012 | Young | A47K 13/14 | 4/245.6 |

* cited by examiner

*Primary Examiner* — Erin Deery
(74) *Attorney, Agent, or Firm* — Timothy A. Bright

(57) ABSTRACT

A portable toilet seat for mounting to an external structure has a seat a primary support webbing, a secondary support webbing, and a waste aperture. The seat forms a rigid platform that is divided into a pair of seat members. Additionally, the pair of seat members are operatively coupled to enable a transition between a stowed, or folded, configuration and a deployed, or flat, configuration. The primary support webbing may be connected between the sides of the seat and the external structure. While the secondary support webbing may be connected between the rear of the seat and the external structure.

19 Claims, 10 Drawing Sheets

SYSTEM AND METHOD FOR MOUNTING A PORTABLE TOILET SEAT TO AN EXTERNAL STRUCTURE

FIELD OF THE INVENTION

The present invention relates generally to convenience items. More specifically, the present invention relates to a reconfigurable toilet that can be mounted onto external structures.

BACKGROUND OF THE INVENTION

Eating is an essential part of human life, and waste is an unavoidable byproduct. In the modern era, eliminating waste is quite simple when indoors. However, the options for comfortably eliminating waste diminish as one gets further away from cities and modern amenities. Because of this, hikers and backpackers are frequently forced to improvise uncomfortable solutions when eliminating excrement.

The present invention addresses the above-stated problem by providing a lightweight toilet that can be attached to trees and external structures. Thereby providing a comfortable perch on which the user can rest while eliminating waste.

DETAIL DESCRIPTIONS OF THE INVENTION

All illustrations of the drawings are for the purpose of describing selected versions of the present invention and are not intended to limit the scope of the present invention.

Referring to FIG. 1 through FIG. 10, the present invention, the portable toilet system, is a device that enables a user to attach a toilet seat to a tree, or other external structure. Thereby, providing a comfortable perch for performing bathroom operations. The term "bathroom operations" is used herein to refer to activities selected from the group comprising defecating, urinating, and vomiting. The present invention is designed to be an adjustable system that can be fastened around trees of varying shapes and sizes. Further, the present invention is designed to be transitioned between a deployed configuration and a stowed configuration. In the deployed configuration, the present invention is attached to the tree and used to support the weight of the user while performing bathroom operations. In the stowed configuration, the present invention is collapsed such that the user is able to place the device into a bag for storage or transport.

Figure 2:
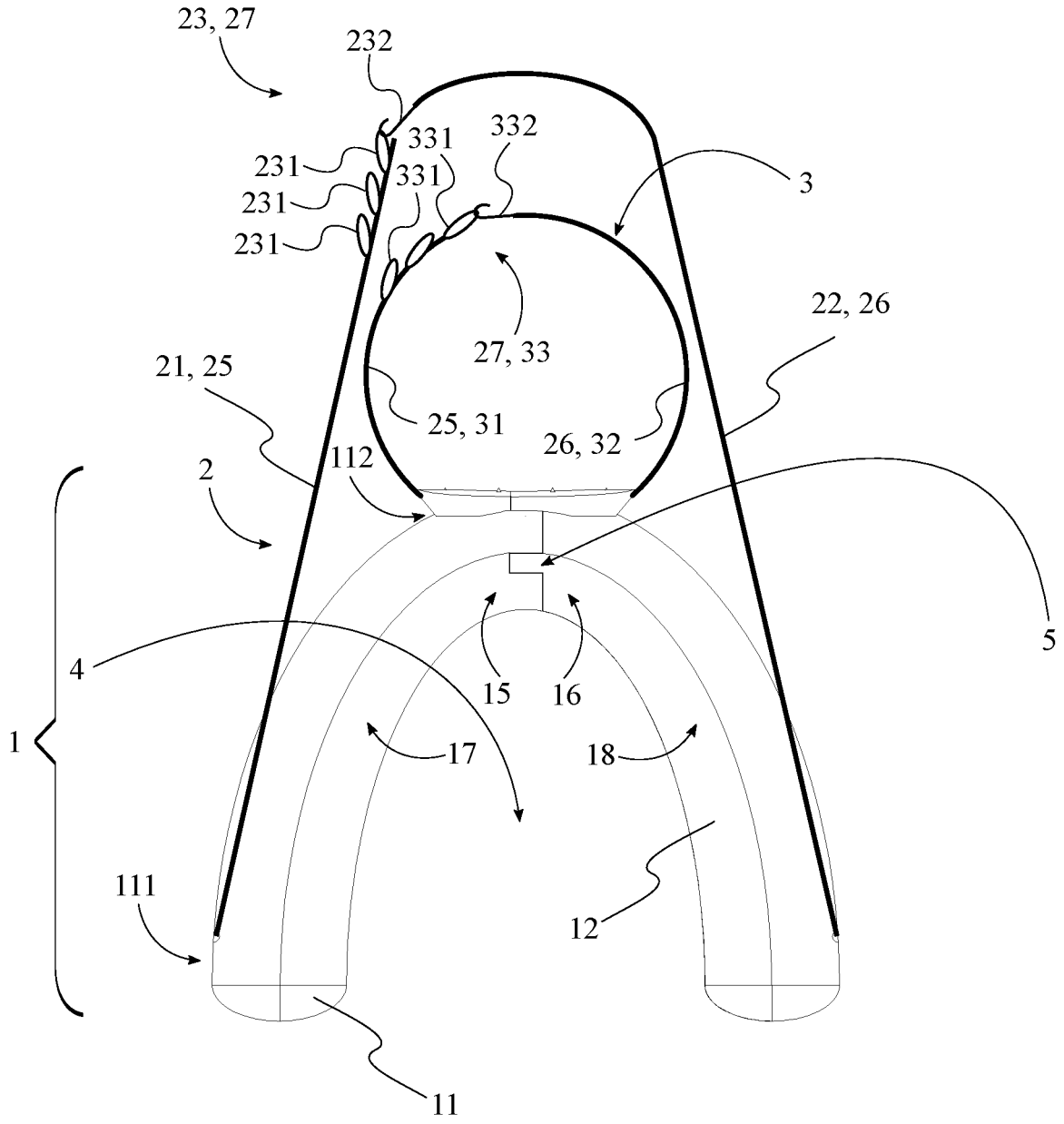
FIG. 2 is a top view of the seat with the primary support webbing and the secondary support webbing in the deployed configuration according to one embodiment of the present invention.

To achieve the above-described functionalities, the present invention comprises a seat 1, a primary support webbing 2, and a secondary support webbing 3. The seat 1 is a rigid structure that comprises a first seat member 11 and a second seat member 12. In some embodiments, the seat 1 is divided into two halves such that the first seat member 11 and the second seat member 12 are mirrored components that are pivotably connected. In some embodiments, the seat 1 is divided into two halves such that the first seat member 11 and the second seat member 12 are detachably connected. Thus, enabling the present invention to transition between the deployed configuration and the stowed configuration by connecting and then disconnecting the first seat member 11 and the second seat member 12. A waste aperture 4 extends through the seat 1 and forms a hole through which waste can be passed while the user is perched atop the seat 1 (FIG. 2).

The primary support webbing 2 and the secondary support webbing 3 are flexible tethering systems that enable the seat 1 to be mounted onto the tree. In some embodiments, the primary support webbing 2 and the secondary support webbing 3 each comprise a first tether 25, a second tether 26, and a fastening mechanism 27. Specifically, the primary support webbing 2 may comprise a first primary tether 21, a second primary tether 22 and a primary fastening mechanism 23. The first primary tether 21 is laterally attached to the first seat member 11. Additionally, the second primary tether 22 is laterally attached to the second seat member 12. Further, the primary fastening mechanism 23 is connected in between the first primary tether 21 and the second primary tether 22 and is positioned offset from the seat 1 across the primary support webbing 2. As a result, the user is able to anchor the first primary tether 21 and the second primary tether 22 to the tree by wrapping the two tethers around the tree and then engaging the primary fastening mechanism 23. This connection enables the first primary tether 21 and the second primary tether 22 to form supports that transfer the weight of the user into the tree while performing bathroom operations (FIG. 2). Further, the user transitions the present invention into the deployed configuration by engaging the primary fastening mechanism 23 and mounting the seat 1 to the tree or external structure 7. Likewise, the user transitions the present invention into the stowed configuration by disengaging the primary fastening mechanism 23 and dismounting the present invention from the tree.

The secondary support webbing 3 adds an additional anchor point that prevents the seat 1 from being laterally or angularly displaced, once mounted to the tree. To facilitate this, embodiments of the secondary support webbing 3 comprise a first secondary tether 31, a second secondary tether 32 and a secondary fastening mechanism 33. The first secondary tether 31 is laterally attached to the first seat member 11 and is positioned offset from the first primary tether 21, across the first seat member 11. Additionally, the second secondary tether 32 is laterally attached to the second seat member 12 and is positioned offset from the second primary tether 22, across the second seat member 12. Further, the secondary fastening mechanism 33 is connected in between the first secondary tether 31 and the second secondary tether 32 and is positioned offset from the seat 1 across the secondary support webbing 3. As a result, the user is able to anchor the first secondary tether 31 and the second secondary tether 32 to the tree by wrapping the two tethers around the tree and then engaging the secondary fastening mechanism 33. This connection enables the first secondary tether 31 and the second secondary tether 32 to form stabilizing anchors that retain the seat 1 in a desired position and orientation while the user is performing bathroom operations. Further, the user transitions the present invention into the deployed configuration by engaging the secondary fastening mechanism 33 and mounting the seat 1 to the tree or external structure 7. Likewise, the user transitions the present invention into the stowed configuration by disengaging the secondary fastening mechanism 33 and dismounting the present invention from the tree.

Figure 5:
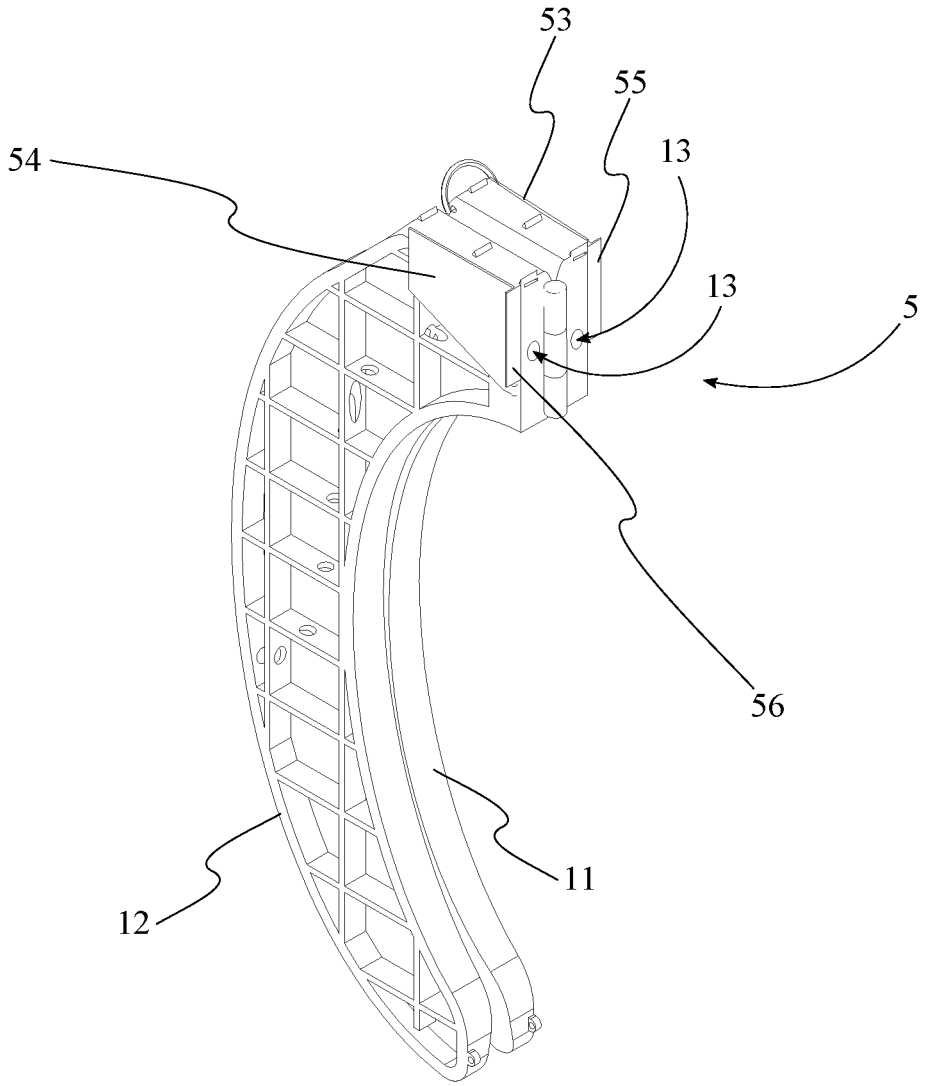
FIG. 5 is a perspective view of the seat in the stowed configuration according to one embodiment of the present invention.

In some embodiments, the primary support webbing 2 facilitates keeping the first seat member 11 and the second seat member 12 connected to each other while in the deployed configuration. To facilitate this, the seat 1 comprises a primary support channel 13 (FIGS. 2 and 5). Additionally, the primary support webbing 2 further comprises a seat support portion 24 that is connected in between the first primary tether 21 and the second primary tether 22. The primary support channel 13 traverses through the seat 1 and is contoured along the shape of the seat 1. That is, the primary support channel 13 traverses into the lateral surface of the first seat member 11, traverses through the mounting portion 15 of the first seat member 11 into the mounting portion 16 of the second seat member 12 at the connection point between the first seat member 11 and the second seat member 12, and then exits the second seat member 12 through the lateral surface of the second seat member 12. Consequently, the primary support channel 13 forms a channel through which the seat support portion 24 of the primary support webbing 2 is threaded. The primary support channel 13 is advantageously configured such that the force of the user's weight being supported by the first primary tether 21 and the second primary tether 22 is transferred through the seat support portion 24 to press the first seat member 11 against the second seat member 12. Thus, providing the necessary force to prevent the first seat member 11 from becoming disconnected from the second seat member 12 during bathroom operations.

Figure 6:
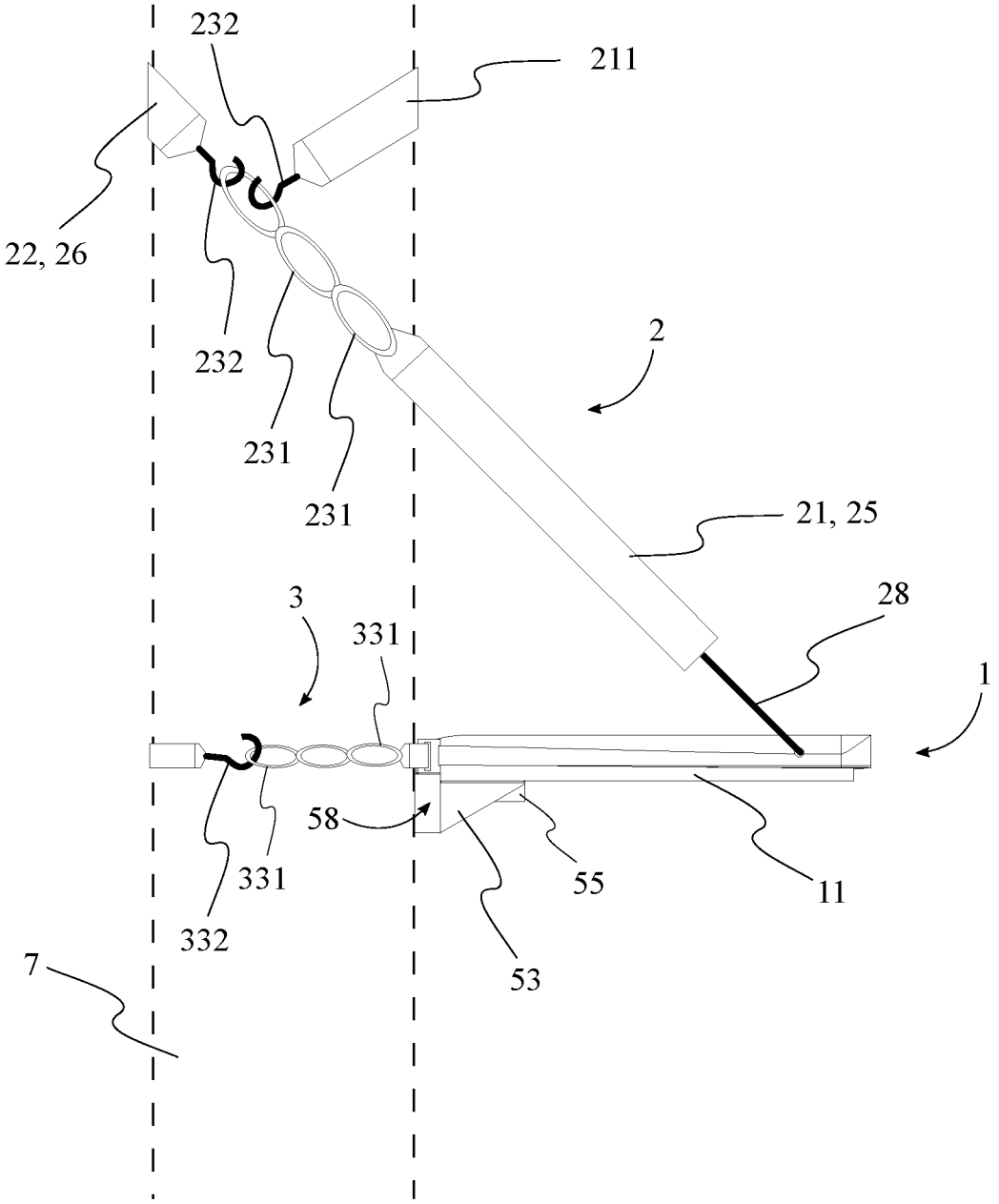
FIG. 6 is a left-side view of the seat attached to the external structure in the deployed configuration according to one embodiment of the present invention.
Figure 7:
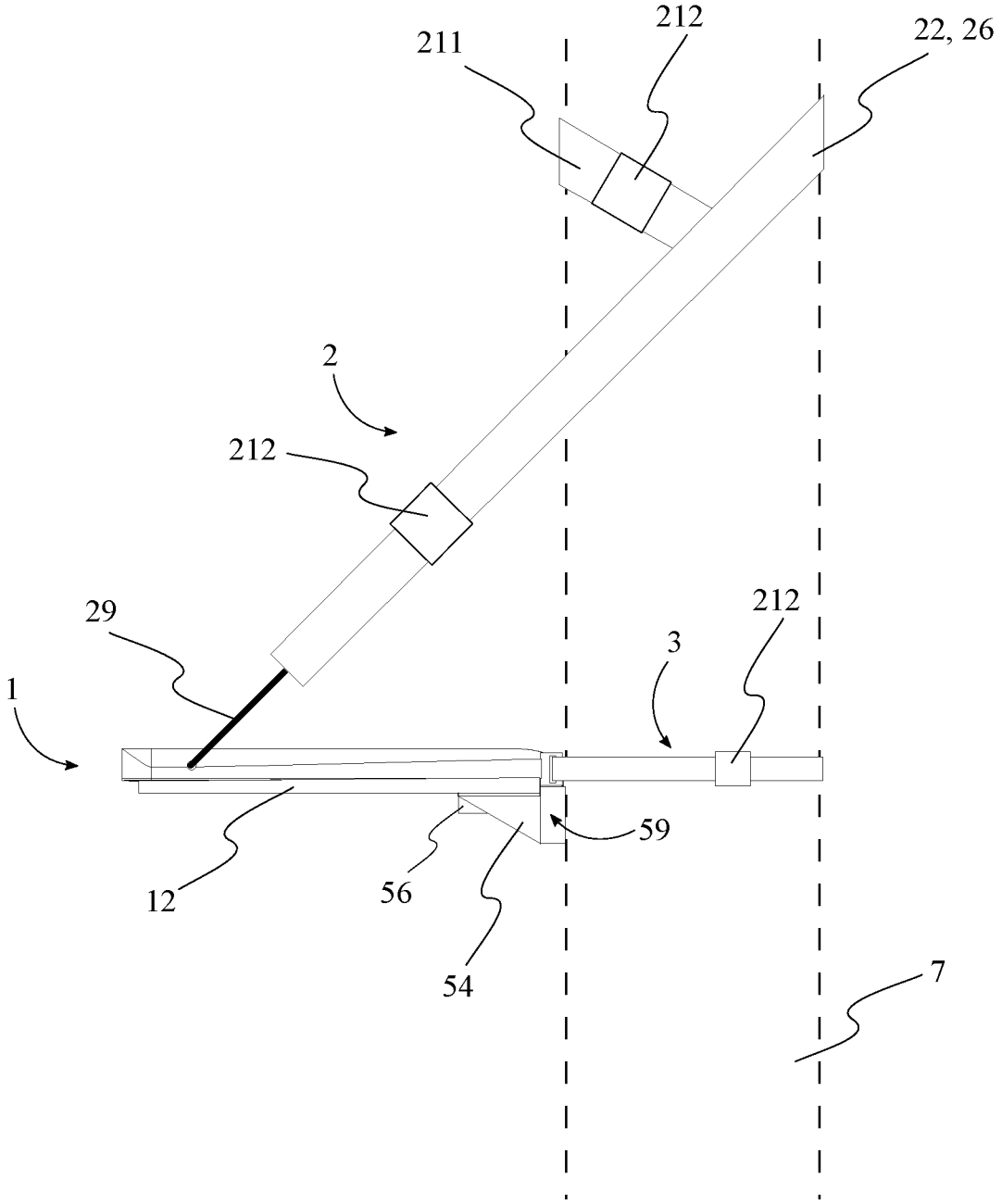
FIG. 7 is a right-side view of the seat attached to the external structure in the deployed configuration according to one embodiment of the present invention.

Supplemental embodiments of the present invention further comprise a first webbing guide 28 and a second webbing guide 29. The first webbing guide 28 and the second webbing guide 29 are hollow tubes used to position the first primary tether 21 and the second primary tether 22 while in the deployed configuration. Specifically, the first webbing guide 28 is mounted over the end of the primary support channel 13 that traverses through the lateral surface of the first seat member 11 (FIG. 6). Likewise, the second webbing guide 29 is mounted over the end of the primary support channel 13 that traverses through the lateral surface of the second seat member 12 (FIG. 7). The seat support portion 24 is threaded through the first webbing guide 28 and the second webbing guide 29. As a result, the user is able to reposition the first webbing guide 28 and the second webbing guide 29 to accommodate users of varying shapes and sizes. Some embodiments of the present invention are designed with telescoping webbing guides 28, 29 that can be extended or retracted to act as standoffs which keep the first primary tether 21 and the second primary tether 22 positioned offset from the user's sides while performing bathroom operations.

Figure 1:
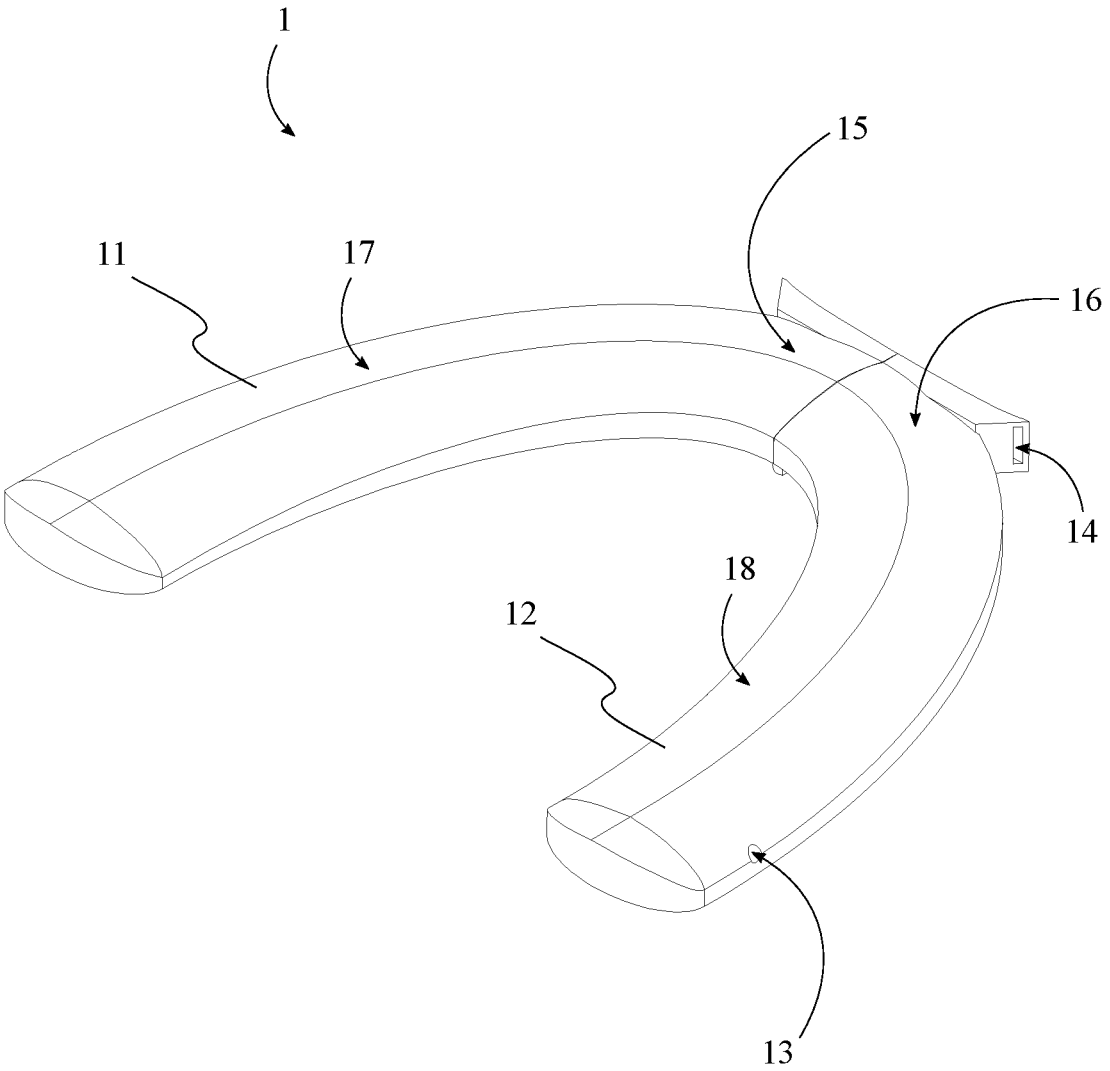
FIG. 1 is an isometric perspective view of a portable toilet seat system according to one embodiment of the present invention.
Figure 3:
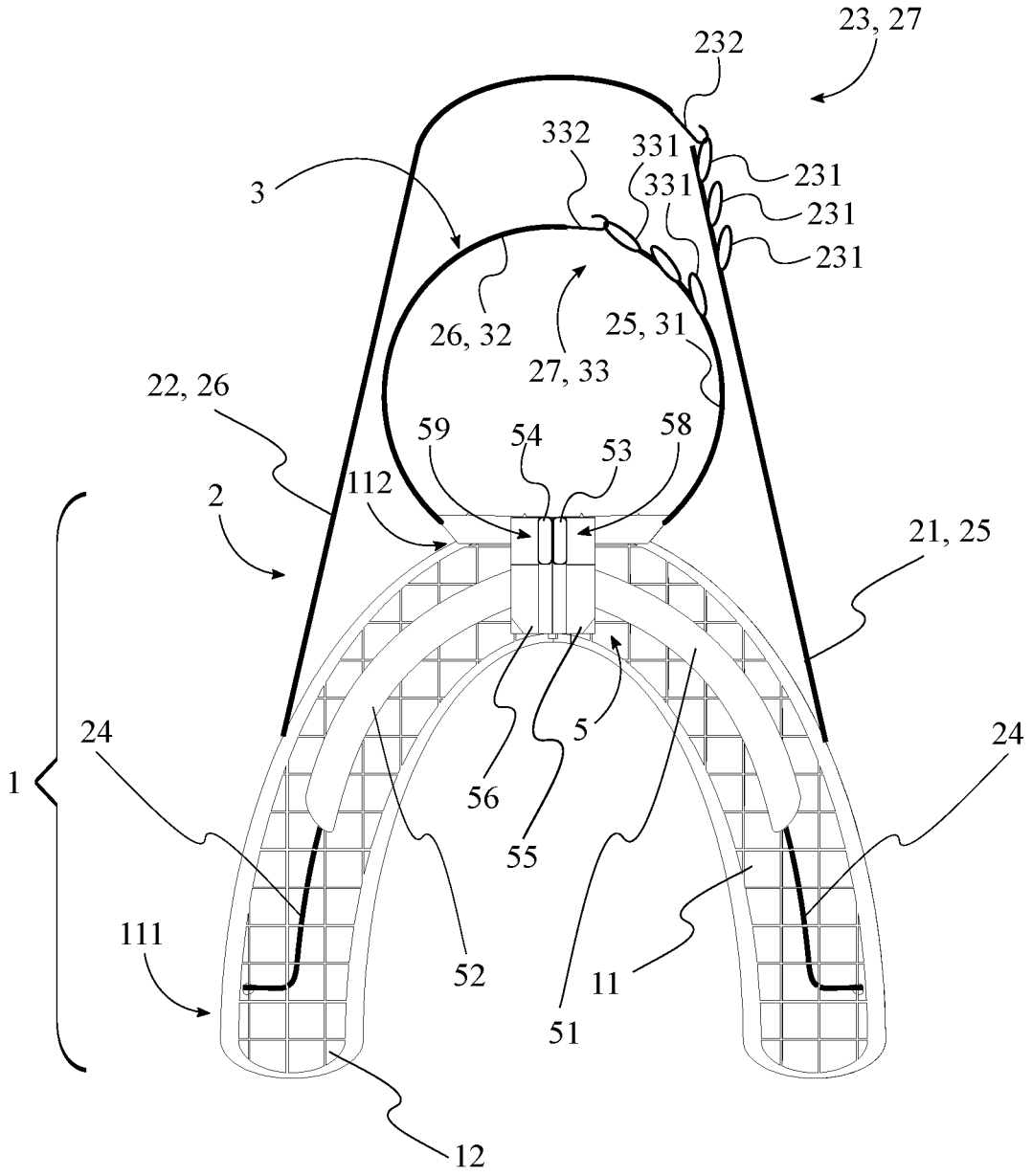
FIG. 3 is a bottom view of the seat with the primary support webbing and the secondary support webbing in the deployed configuration according to one embodiment of the present invention.

In some embodiments, a user-support surface of the first seat member 11 is disposed coplanar to a user-support surface of the second seat member 12 while in the deployed configuration (FIG. 1). That is, the surface on which the user rests while performing bathroom operations is formed by the first seat member 11 and the second seat member 12 being retained in a sufficiently coplanar orientation while in the deployed configuration. While in the deployed configuration, a mounting portion 15 of the first seat member 11 is disposed adjacent to a mounting portion 16 of the second seat member 12 so that the two seat members are able to form a platform on which the user rests. While in the deployed configuration, the primary support webbing 2 is connected between the seat 1 and the external structure 7. Additionally, the secondary support webbing 3 is connected between the mounting portion 15 of the seat 1 members and the external structure 7. As shown in FIG. 3, the primary support webbing 2 may be connected between a free end 111 of the seat 1 and the external structure 7 so that the front portion of the seat 1 is supported. in some embodiments, the secondary support webbing 3 forms a second connection point that is wrapped around the tree trunk when deploying the seat 1.

In some embodiments, the disclosed concept is transitioned into the stowed configuration by positioning the user-support surface of the first seat member 11 parallel to the user-support surface of the second seat member 12 so that the two seat members are folded toward each other to make a more compact structure (FIG. 5). Further, in the stowed configuration, the primary support webbing 2 and the secondary support webbing 3 are disconnected from the external structure 7.

In some embodiments, the present invention further comprises a locking brace 5 that is connected between a mounting portion 15 of the first seat member 11 and a mounting portion 16 of the second seat member 12 such that a fixed end 112 of the seat 1 may transfer a portion of the weight of the user into the tree or external structure 7 (FIGS. 3-7). In some embodiments, the locking brace 5 may be a latching mechanism that retains the seat 1 in the deployed configuration once engaged. In further embodiments, the locking brace 5 pivotably couples the mounting portion 15 of the first seat member 11 to the mounting portion 16 of the second seat member 12 such that the user-support surface of the first seat member 11 can be transitioned between being disposed coplanar with, or parallel to, the user support surface of the second seat member 12 by being pivoted about the locking brace 5. Additionally, the locking brace 5 may function as a support structure that reinforces the first seat member 11 and the second seat member 12 while the seat 1 is in the deployed configuration. The locking brace 5 may comprise a first support arm 51 a second support arm 52, a first lock arm 53, a second lock arm 54, a first locking detent 55, and a second locking detent 56.

In some embodiments, the configuration of components for the first support arm 51, the first lock arm 53, and the first locking detent 55 is mirrored by the configuration of components for the second support arm 52, the second lock arm 54, and the second locking detent 56. Accordingly, descriptions relating to the first support arm 51, the first lock arm 53, and the first locking detent 55 are applicable to the second support arm 52, the second lock arm 54, and the second locking detent 56.

Figure 4:
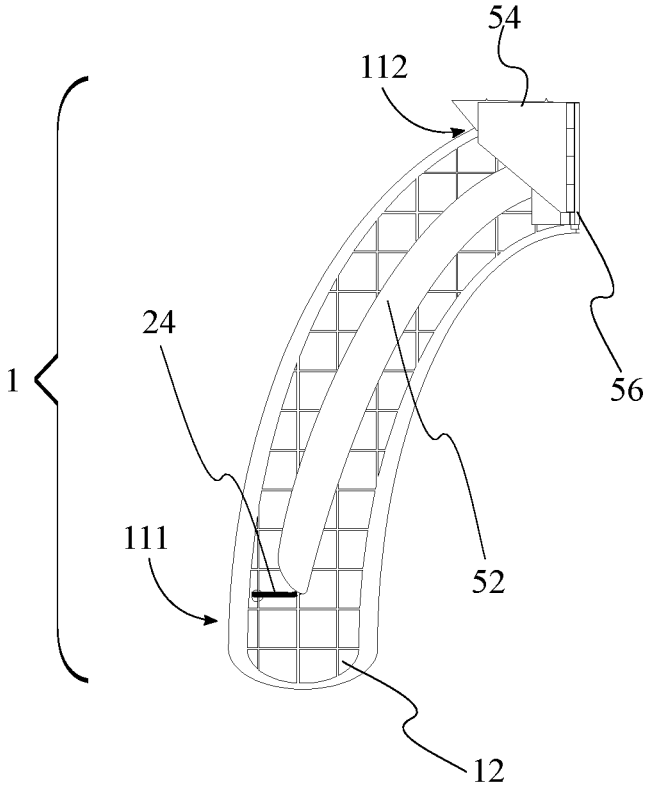
FIG. 4 is a top view of the seat in the stowed configuration according to one embodiment of the present invention.

The first support arm 51 may be coupled to an underside of the first seat member 11 and/or integrated into the first seat member 11, opposite to the user-support surface of the first seat member 11. In an embodiment, the first support arm 51 runs the length of the first seat member 11 so that the entire weight of the user is supported by the first support arm 51 (FIG. 4). The first support arm 51 may be shaped to conform to a contour of the first seat member 11 such that the first support arm 51 mimics the shape of the first seat member 11. In some embodiments, the first locking detent 55 extends from the first support arm 51 away from the user-support surface. The first lock arm 53 may be pivotably coupled to the underside of the seat 1. Additionally, the first lock arm 53 may be positioned in between the first support arm 51 and the first locking detent 55. In some embodiments the first lock arm 53 and the second lock arm 54 work in concert to retain the seat 1 in the deployed configuration once the two lock arms are engaged to each other. For example, engaging the first lock arm 53 with the second lock arm 54 may press the first locking detent 55 against the second locking detent 56 (FIGS. 6-7). Thereby preventing the user-support surfaces 17 and 18 from being moved out of a coplanar orientation. In some embodiments, a first lock receptacle 58 traverses into the first locking detent 55 and a second lock receptacle 59 traverses into the second locking detent 56 to function as reliefs into which the first lock arm 53 and the second lock arm 54 may be inserted when transitioning the first seat 1 into the deployed configuration.

The engaged lock arms 53 and 54 further function as a stabilization arm that is pressed against the external structure 7 and transfers load from the seat 1 into the external structure 7 to reduce the strain on the primary tether 2 and the secondary tether 3 and to prevent unwanted displacement of the seat 1 while performing bathroom operations. In further embodiments, a fixed end of a latch is pivotably coupled to the first lock arm 53 and the free end of the latch is detachably connected to the second lock arm 54 to prevent the locking brace 5 from being transitioned out of the deployed configuration until the latch is disengaged. To transition the seat 1 into the stowed configuration, the first lock arm 53 is disengaged from the second lock arm 54 and rotated toward the first support arm 51. In some embodiments, an arm retention clip or first arm retention receptacle 58 is integrated into the first support arm 51 to retain the first lock arm 53 in the stowed configuration. In some embodiments, a second arm retention receptacle 59 is integrated into the second support arm 52 to retain the second lock arm 54 in the stowed configuration FIGS. 3-4.

To facilitate remaining fixedly attached to the tree, the present invention may further comprise a tree-support anchor a plurality of anchor protrusions, and a secondary support channel 14 (FIGS. 1 and 5). Additionally, the primary support webbing 2 further comprises an anchor support portion that is connected in between the first secondary tether 31 and the second secondary tether 32. The tree-support anchor is a rigid member that enables the present invention to remain fixedly attached to the tree. Preferably, the support anchor is a two-part wedge that is mounted onto a rear surface of the seat 1. That is, a first half of the tree-support anchor is mounted adjacent to the rear surface of the first seat member 11 while a second half of the tree-support anchor is mounted adjacent to the rear surface of the second seat member 12. Thus positioned, the tree-support anchor enables the seat 1 to be held at a desired angle relative to a longitudinal axis of the tree. A semicircular cavity is cut out of the tree support anchor to enable the tree-support anchor to conform to the shape of the tree. The plurality of anchor protrusions is distributed across the semicircular cavity. As a result, the plurality of anchor protrusions bite into the surface of the tree to prevent the seat 1 from becoming dislodged from the tree while the present invention is in the deployed configuration. The secondary support channel 14 traverses through the first half of the tree-support anchor and the second half of the tree support anchor. Consequently, the secondary support channel 14 forms a channel through which the seat support portion 24 of the secondary support webbing 3 is threaded. In some embodiments, the primary support channel 13 extends through the first support arm 51 and the second support arm 52. Additionally, the secondary support channel 14 extends through the first locking detent 55 and the second locking detent 56. Thereby, making the locking brace 5 the primary load bearing component of the seat 1. In supplemental embodiments, the tree-support anchor is a rigid panel that is oriented parallel to the longitudinal axis of the tree and provides further support to retain the seat 1 in a desired orientation while in the deployed configuration. In these embodiments a plurality of secondary support webbing 3 straps is distributed along the length of the rigid panel and used to secure the present invention to the tree.

The present invention is designed to be attached to trees of varying shapes and sizes. To facilitate this, the first primary tether 21, the second primary tether 22, the first secondary tether 31, and the second secondary tether 32 are all length adjustable straps (FIGS. 3 and 7). Additionally, in some embodiments, the primary fastening mechanism 23 comprises at least one primary anchor point 231 and at least one primary anchor coupler 232. The at least one primary anchor point 231 is integrated into the first primary tether 21 and positioned offset from the first seat member 11 across the first primary tether 21. The at least one primary anchor coupler 232 is integrated into the second primary tether 22 and positioned offset from the second seat member 12 across the second primary tether 22. Accordingly, the primary anchor point 231 and the primary anchor coupler 232 work in concert to enable the second primary tether 22 to be wrapped around the tree and attached to the first primary tether 21. In some embodiments the at least one primary anchor point 231 is a plurality of primary anchor points 231 that is distributed along the first primary tether 21 and the user is able to adjust the length of the primary support webbing 2 by attaching the primary anchor coupler 232 to a desired anchor point from the plurality of primary anchor points 231. In a supplemental embodiment, the primary fastening mechanism 23 includes a strap with a plurality of loops 231 and a hook 232 that wrap around the tree (FIG. 2). The first primary tether 21 and the second primary tether 22 are terminally attached to the looped strap 231 and the hook 232 such that the length of the primary support webbing 2 may be adjusted by hooking the hook 232 onto one of the plurality of loops 231. In further embodiments, the primary fastening mechanism 23 and the secondary fastening mechanism 33 may be quick-release couplers that can rapidly connect and disconnect the two ends of each tether 2 and 3. In some embodiments, length adjustment devices 212 may be integrated into the second tether 26 and a supplemental sinching tether 211 (FIG. 7). The supplemental sinching tether 211 may be a section of webbing that extends from the second primary tether 22 and can be attached to at least one of the primary anchor points 231 to retain the first primary tether 21 and the second primary tether 22 in place around the external structure 7. The length adjustment devices 212 may be buckles that are integrated along the lengths of the second tether 26 and the supplemental sinching tether 211 to enable the tethers to be shortened or elongated by playing out or reeling in lengths of tether through the length adjustment devices 212.

Similar to the primary support webbing 2, in some embodiments, the secondary fastening mechanism 33 comprises at least one secondary anchor point 331 and at least one secondary anchor coupler 332. The at least one secondary anchor point 331 is integrated into the first secondary tether 31 and positioned offset from the tree-support anchor across the first secondary tether 31. The at least one secondary anchor coupler 332 is integrated into the second secondary tether 32 and positioned offset from the tree-support anchor across the second secondary tether 32. Accordingly, the secondary anchor point 331 and the secondary anchor coupler 332 work in concert to enable the second secondary tether 32 to be wrapped around the tree and attached to the first secondary tether 31. In some embodiments the at least one secondary anchor point 331 is a plurality of secondary anchor points 331 that is distributed along the first secondary tether 31 and the user is able to adjust the length of the secondary support webbing 3 by attaching the secondary anchor coupler 332 to a desired anchor point from the plurality of secondary anchor points 331.

In some embodiments, the seat 1 may be constructed from antimicrobial and/or hypoallergenic materials that prevent the accumulation and transmission of unwanted contaminants (e.g., bacteria, viruses, chemical contaminants). In further embodiments, the seat 1 may be constructed from resilient materials that enable the user to comfortably relax while remaining supported by the seat 1. In some embodiments, the seat 1, the primary support webbing 2, and the secondary support webbing 3 have a maximum operating range of at least 300 lbs.

Figure 8:
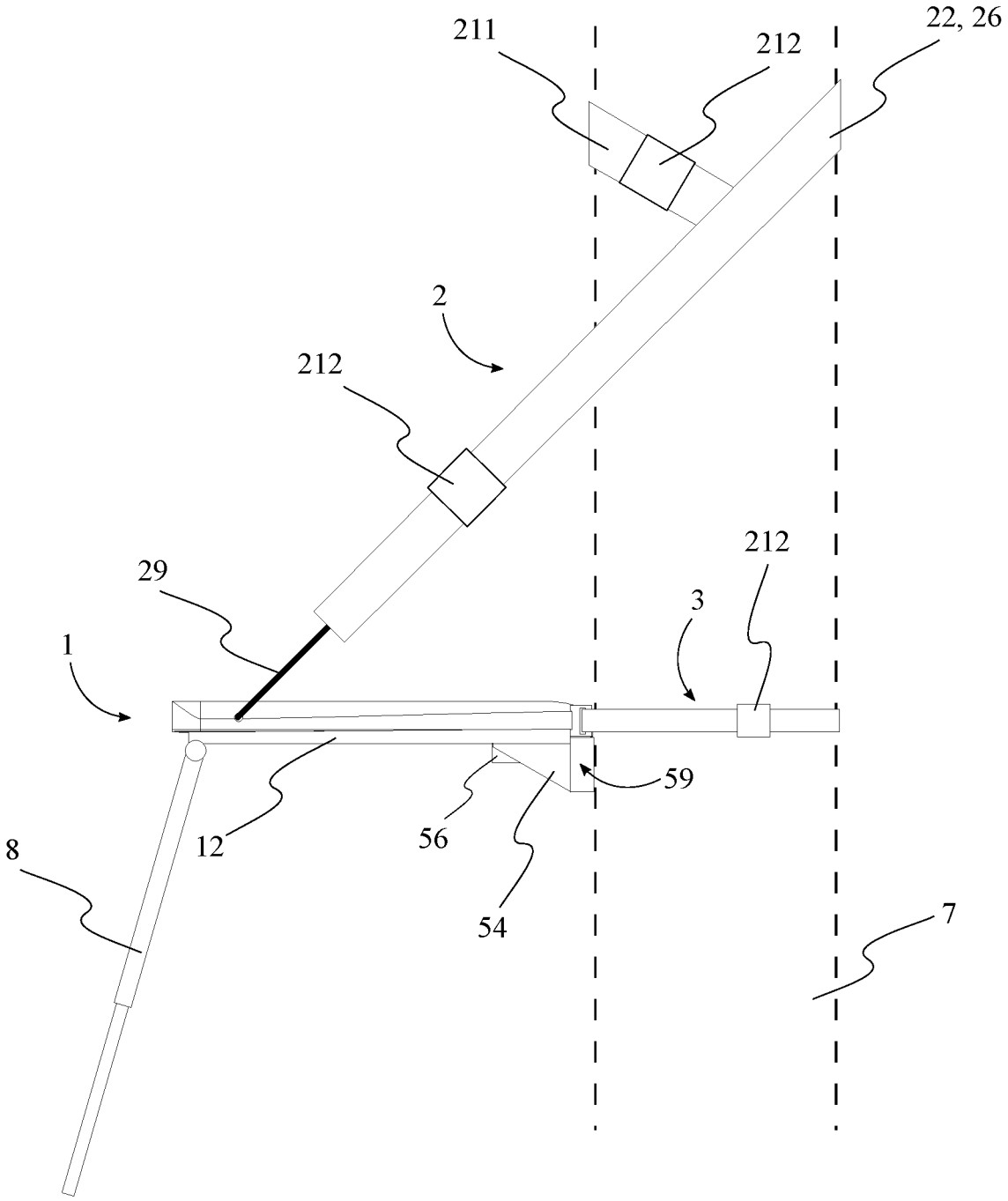
FIG. 8 is a right-side view of a telescoping leg attached to the seat while in the deployed configuration according to one embodiment of the present invention.
Figure 9:
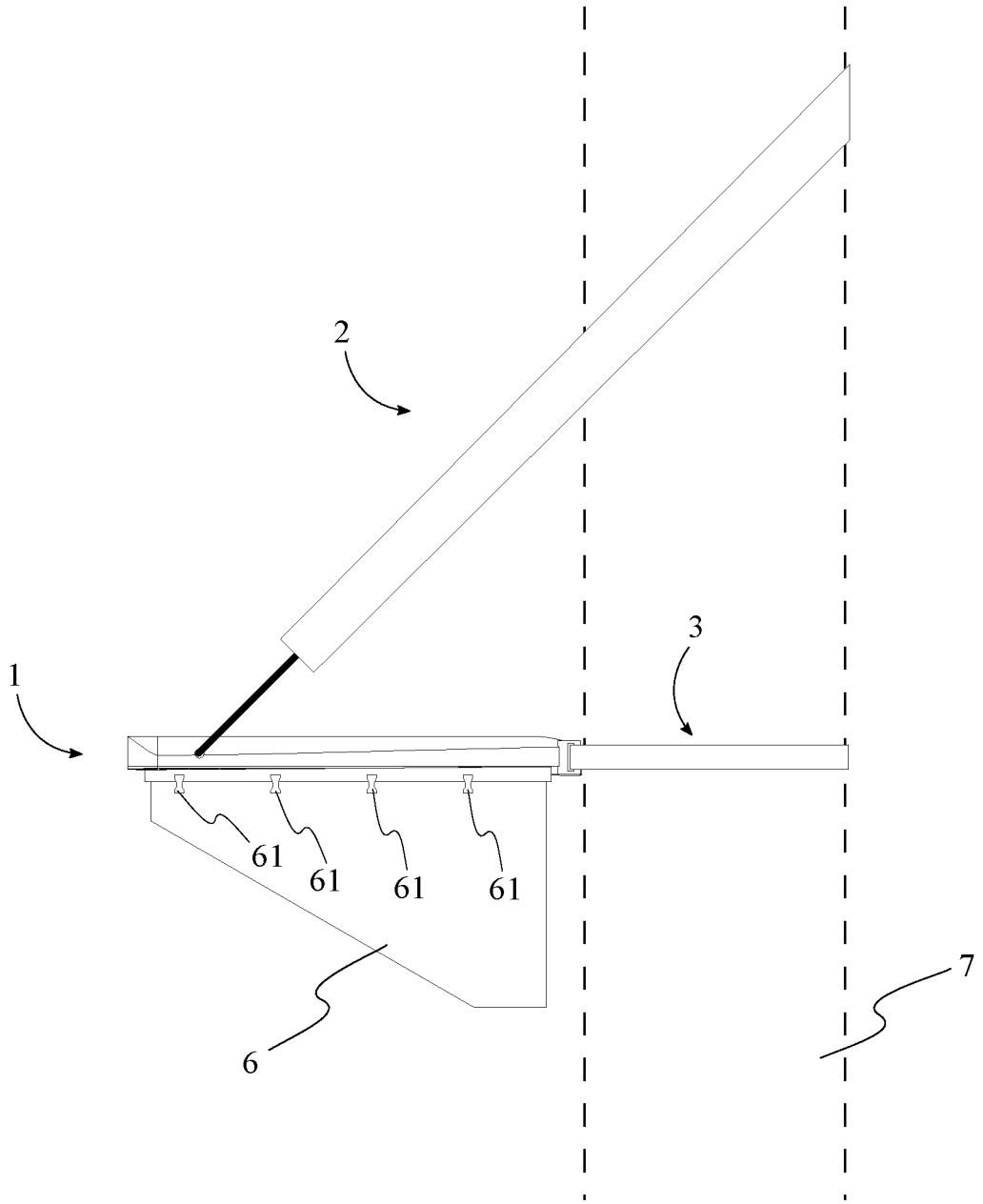
FIG. 9 is a right-side view of a waste receptacle attached to the seat with a series of clips while the seat is in the deployed configuration according to one embodiment of the present invention.
Figure 10:
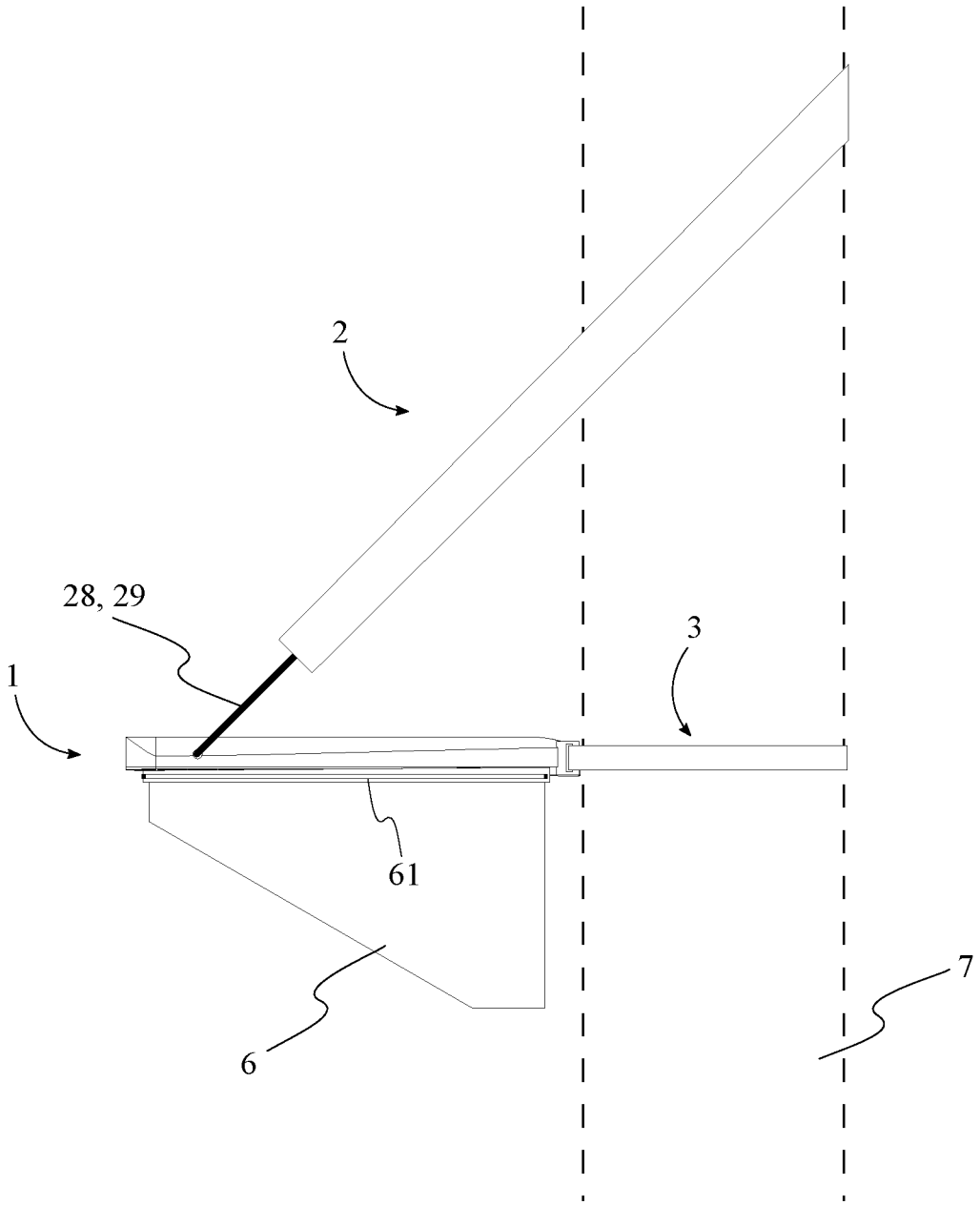
FIG. 10 is a right-side view of a waste receptacle attached to the seat with a zip-lock or zippering mechanism while the seat is in the deployed configuration according to one embodiment of the present invention.

The present invention is designed to enable the user to perform bathroom operations in an ecologically responsible way. To facilitate this, the present invention further comprises a waste receptacle 6 (FIGS. 9-10). The waste receptacle is designed to be detachably mounted onto an underside of the seat 1. Additionally, the waste receptacle 6 is designed to function as a sealable container that catches waste which passes through the waste aperture 4. Preferably, the waste receptacle 6 is a flexible biodegradable bag with a sealing mechanism positioned over its opening. In some embodiments, the opening of the waste receptacle 6 is concentrically aligned with the waste aperture 4. Thus, the user is able to collect and transport their waste for appropriate disposal. In further embodiments, a mounting device 61 may be connected between the seat 1 and the waste receptacle 6. In some embodiments, the mounting device 61 may be a plurality of clips 61 that fasten around a perimeter of the waste receptacle 6 such that the waste receptacle 6 is disposed concentric to the waste aperture 4 (FIG. 9); thereby, facilitating waste capture. In further embodiments, the mounting device 61 may be a zip lock or zippering system capable of quickly attaching and detaching a perimeter of the waste receptacle 6 to the seat 1 (FIG. 10). In further embodiments, at least one length-adjustable support leg 8 is pivotably coupled to the free end 111 of the seat 1 (FIG. 1 and FIG. 8). For example. A pair of telescoping legs 8 may be hingedly connected to the seat such that a first telescoping leg is mounted to the first seat member 11 and a second telescoping leg is mounted to the second seat member 12. The telescoping leg 8 may be extended to support the user during bathroom operations and then retracted and folded away while the seat 1 is in the stowed configuration.

Although the invention has been explained in relation to its preferred embodiment, it is to be understood that many other possible modifications and variations can be made without departing from the spirit and scope of the invention.

What is claimed is:

1. A portable toilet seat system for mounting to an external structure comprising:

a seat;

a primary support webbing;

a secondary support webbing;

a waste aperture;

the seat comprising a first seat member, a second seat member, and a locking brace, wherein the locking brace is connected between a mounting portion of the first seat member and a mounting portion of the second seat member;

the first seat member is operatively coupled to the second seat member, wherein the first seat member and the second seat member are able to transition between a stowed configuration and a deployed configuration;

the primary support webbing is laterally attached to the seat;

the secondary support webbing is laterally attached to the seat and positioned offset from the primary support webbing across the seat; and the waste aperture extends through the first seat member and the second seat member.

2. The portable toilet seat system of claim 1 comprising:

the primary support webbing and the secondary support webbing each comprising a first tether and a second tether;

the first tether is laterally attached to the first seat member; and the second tether is laterally attached to the second seat member.

3. The portable toilet seat system of claim 2 comprising:

the seat further comprising a primary support channel;

the primary support webbing further comprising a primary support portion;

the primary support channel extends through the first seat member and the second seat member;

the primary support portion is terminally connected between the first tether and the second tether of the primary support webbing; and the primary support portion is threaded through the primary support channel.

4. The portable toilet seat system of claim 3 wherein the primary support channel is contoured along a shape of the seat.

5. The portable toilet seat system of claim 3 comprising:

a first webbing guide;

a second webbing guide;

the first webbing guide is terminally connected to the primary support channel; and the first webbing guide is disposed adjacent to a lateral surface of the first seat member;

the second webbing guide is terminally connected to the primary support channel; and the second webbing guide is disposed adjacent to a lateral surface of the second seat member.

6. The portable toilet seat system of claim 5 wherein a seat support portion is threaded through the first webbing guide and the second webbing guide.

7. The portable toilet seat system of claim 3 comprising:

the seat further comprising a secondary support channel;

the secondary support webbing further comprising a secondary support portion;

the secondary support channel extends through the first seat member and the second seat member;

the secondary support portion is terminally connected between the first tether and the second tether of the secondary support webbing; and the secondary support portion is threaded through the secondary support channel.

8. The portable toilet seat system of claim 2 comprising:

the primary support webbing and the secondary support webbing each further comprising a fastening mechanism;

the fastening mechanism is connected between the first tether and the second tether; and the fastening mechanism is positioned offset from the seat across the first tether and the second tether.

9. The portable toilet seat system of claim 8 comprising:

the fastening mechanism comprising at least one anchor point and at least one anchor coupler;

the at least one anchor point is integrated into the first tether and positioned offset from the first seat member across the first tether;

at least one anchor coupler is integrated into the second tether and positioned offset from the second seat member across the second tether; and the at least one anchor coupler is detachably connected to the at least one anchor point.

10. The portable toilet seat system of claim 8, wherein the fastening mechanism is an adjustable buckle connected.

11. The portable toilet seat system of claim 8, wherein the seat is in the deployed configuration:

a user-support surface of the first seat member is disposed coplanar to a user-support surface of the second seat member;

the mounting portion of the first seat member is disposed adjacent to the mounting portion of the second seat member;

the locking brace is engaged;

the primary support webbing is connected between the seat and the external structure; and the secondary support webbing is connected between the mounting portion of the seat and the external structure.

12. The portable toilet seat system of claim 8, wherein the seat is in the stowed configuration:

a user-support surface of the first seat member is disposed parallel to a user-support surface of the second seat member;

the locking brace is disengaged;

the primary support webbing is disconnected from the external structure; and the secondary support webbing is disconnected from the external structure.

13. The portable toilet seat system of claim 1, wherein the seat is constructed from antimicrobial materials.

14. The portable toilet seat system of claim 1, wherein the seat is constructed from resilient materials.

15. The portable toilet seat system of claim 1, wherein the seat, the primary support webbing, and the secondary support webbing have a maximum operating range of at least 300 lbs.

16. The portable toilet seat system of claim 1, further comprising a waste receptacle is detachably attached to the seat; and a mounting device is connected between the seat and the waste receptacle.

17. The portable toilet seat system of claim 16, wherein the mounting device is a plurality of clips.

18. The portable toilet seat system of claim 1, wherein at least one length-adjustable support leg is pivotably coupled to a free end of the seat.

19. A method for mounting a portable toilet seat to an external structure comprising:

providing a seat, wherein the seat comprises a first seat member and a second seat member and a waster aperture extending through the first seat member and second seat member;

providing a primary support webbing and a secondary support webbing, wherein the primary support webbing is laterally attached to the seat, and wherein the secondary support webbing is laterally attached to the seat and positioned offset from the primary support webbing across the seat;

transitioning the seat into a deployed configuration, and wherein a user-support surface of the first seat member is disposed coplanar to a user-support surface of the second seat member when in the deployed configuration;

engaging a locking brace, wherein a mounting portion of the first seat member is retained adjacent to a mounting portion of the second seat member when the locking brace is engaged;

connecting the primary support webbing to the external structure;

and connecting the secondary support webbing to the external structure.

* * * * *